United States Patent [19]

Neighbors

[11] 4,256,201

[45] Mar. 17, 1981

[54] SCAFFOLDING FRAME MEMBERS

[76] Inventor: James Neighbors, N. 11820 Washington Ct., Spokane, Wash. 99218

[21] Appl. No.: 75,096

[22] Filed: Sep. 13, 1979

[51] Int. Cl.[3] ..... E04G 3/04; E04G 3/12

[52] U.S. Cl. ..... 182/82; 182/150

[58] Field of Search ..... 182/45, 150, 82, 152; 248/237, 235, 240

[56] References Cited

U.S. PATENT DOCUMENTS

| | | | |
|---|---|---|---|
| 77,308 | 4/1868 | Mudge | 182/45 |
| 2,308,142 | 1/1943 | Alloway | 182/45 |
| 2,966,228 | 12/1960 | Kowalski | 182/150 |
| 3,135,351 | 6/1964 | Economos | 182/150 |
| 3,150,890 | 9/1964 | Sego et al. | 182/150 |
| 4,074,792 | 2/1978 | Zaugg | 182/150 |
| 4,078,633 | 3/1978 | Fahy | 182/45 |
| 4,122,916 | 10/1978 | Strobel | 182/45 |

FOREIGN PATENT DOCUMENTS

| | | | |
|---|---|---|---|
| 167012 | 10/1950 | Austria | 182/45 |

*Primary Examiner*—Reinaldo P. Machado
*Attorney, Agent, or Firm*—Wells, St. John & Roberts

[57] ABSTRACT

A scaffolding frame member to be used for supporting scaffolding planks along the side of a building structure and adjacent the roof thereof. Each member is basically comprised of four folding parts, a roof member, an upright channel, a turnbuckle connected between the roof member and channel, and a bottom brace member. All four members fold together to form a compact unit for easy storage and transport. The frame member is mounted to a structure by first securing the roof member to the roof structure or frame with the channel and bottom brace hanging over the structure side. The turnbuckle mechanism can then be tightened between the roof member and suspended channel member to pull the channel member inwardly and press the bottom brace firmly against the structure wall. The bottom brace may then be secured to the wall.

8 Claims, 6 Drawing Figures

SCAFFOLDING FRAME MEMBERS

BACKGROUND OF THE INVENTION

The present invention relates to portable scaffolding supported solely by a building structure.

It is well known to use building mounted scaffolding structures to support workmen along the side of a building structure. There is special need for such apparatus, along the areas of residential building structures adjacent the cornice. Without scaffolding, the builder must work dangerously close to a roof edge or make use of ladder or ladder type scaffolding to acquire access to the bottom cornice areas.

Various forms of portable scaffolding have been devised for the purpose of providing access by workers to the cornice area of building structures. Prior scaffolding is typically bulky and therefore very difficult to transport and store. Furthermore, the typical scaffolding frame is a very complex geometric assembly, often taking hours for construction assembly and dismantling that could otherwise be spent in actual building or repair processes.

Complex scaffolding structures are necessarily expensive due to materials and labor involved with the many different components. Further, such complexity leads to human error, and error involved in assembling of such scaffolding can often lead to serious accidents resulting in personal injury.

It therefore becomes desirable to obtain a simplified form of scaffolding frame member that can be easily mounted and removed from a building structure, that folds to a compact storage and transport condition, and that is safe and inexpensive for use by the average builder.

U.S. Pat. No. 4,122,916 to Strobel discloses a scaffolding structure made up of four basic components. The upper, roof-supported component extends downwardly over the fascia where it connects to an upright adjustable column. The column extends downwardly to support the outer end of a horizontal platform support member. A brace extends downwardly from the platform support member to engage the ground surface or be braced against the structure wall. Various adjustments are provided along the length of several of the members.

German Patent No. 1,670,012 to Hartel et al discloses a scaffolding arrangement supported on a building structure adjacent the cornice area. Hartel, like Strobel, utilizes several brace arrangements for supporting the scaffolding frame members on the roof line and along the structure wall. Various adjustments may be made for accommodating roof pitch and overhang.

The present scaffolding member represents an improvement over the prior art by providing a stable, easily mounted scaffolding member that can be folded into an extremely compact storage and transport condition. Furthermore, the present scaffolding member includes a novel tensioning mechanism by which the entire frame structure can be made rigid to the attached building structure, improving safety of the workers it supports.

DETAILED DESCRIPTION OF A PREFERRED EMBODIMENT

Figure 1:
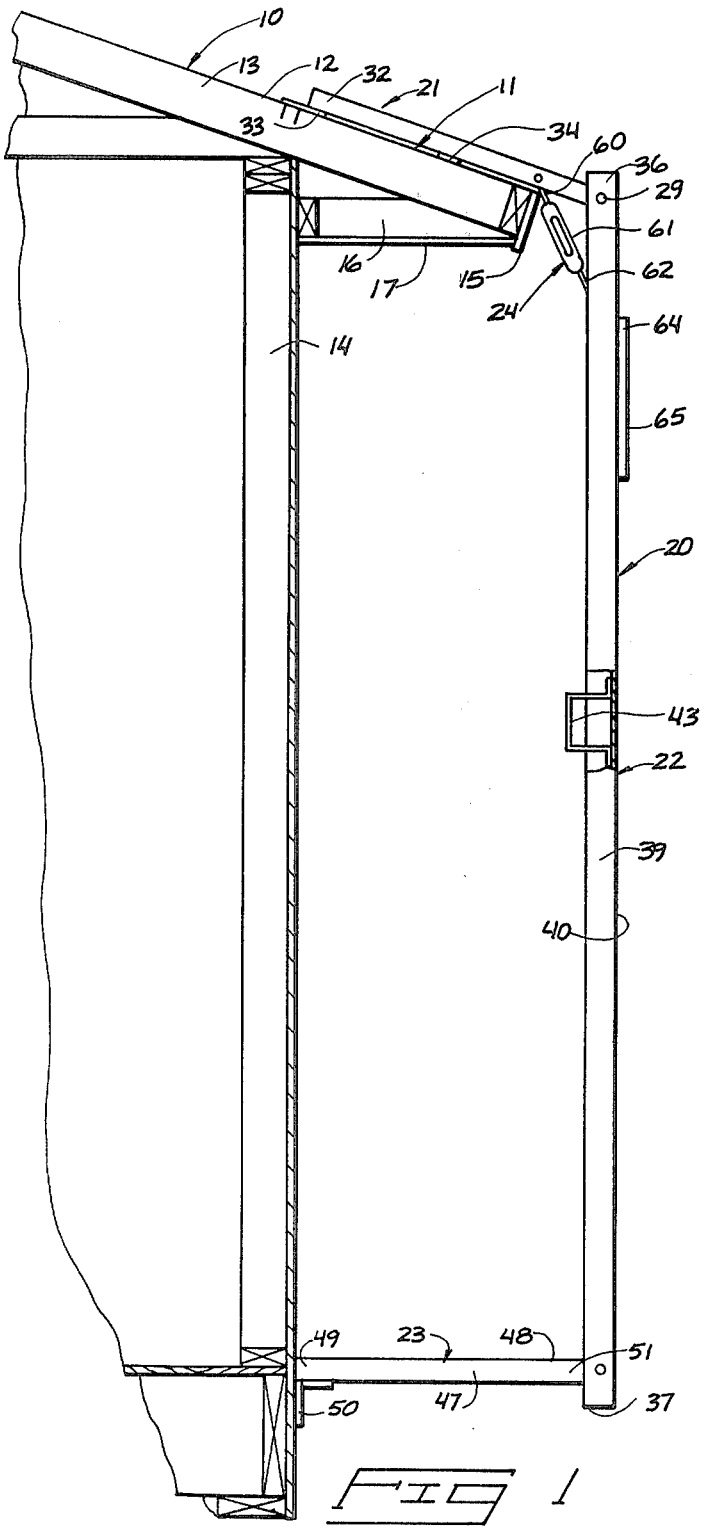
FIG. 1 is an elevational view of the present scaffolding on a building structure.

The present invention is intended for use in the building trades and more particularly in that area of the building trades directed primarily to small commercial and residential structures. An exemplary building structure is partially shown in section at 10 in FIG. 1. The structure 10 is shown by way of example as a typical form of residential construction. Other forms of construction are adapted to as easily by the present invention.

The structure 10 includes a box cornice 11. The cornice 11 is comprised of a portion of the building roof 12. The roof 12 is supported by an angular roof rafter 13. A portion of the rafter 13 extends over the building wall 14 and is thus termed the "overhang". The ends of rafters 13 are typically provided with a fascia board 15 that closes off the free rafter ends and defines the outer limit of the box cornice. A "lookout" 16 extends horizontally from the fascia 15 back to the wall 14. The lookout 16 is typically covered by a plancier 17.

Construction of the box cornice and adjacent elements of the building structure require, preferably, the use of a scaffolding that will enable free movement of the worker at the elevated cornice position. The present scaffolding frame member is intended primarily for use in such construction, but can be useful for many other purposes such as finishing, glazing, painting, etc. where relatively free working access to the cornice area is desired.

The present scaffolding frame member is generally designated in the drawings by the reference character 20. The scaffolding frame member 20 is basically comprised of four interfitting, foldable members. First, a roof engaging member 21 is provided that is adapted to be secured to the structure roof. Member 21 is pivotably mounted to the second member, an upright elongated channel 22. Thirdly, a bottom brace member 23 extends from engagement with the channel 22 to an end adapted to be secured to the building wall. Finally, a turnbuckle means 24 interconnects the roof engaging member 21 and channel 22 for the purpose of securing and bracing the structure when in the open and operative position on a building structure (FIG. 1).

The roof engaging member 21 is shown clearly in FIG. 1. It is folded out of view in FIG. 2. The roof engaging member 21 is pivotably mounted at an inward end 28 to the channel 22. A pin 29 is provided to pivotably interconnect the channel and member 21. The pin may be slidably journalled within an appropriate sleeve 30 (FIG. 3) that will allow relatively free pivotal movement of the roof engaging member 21 about an axis transverse to channel 22 between the folded storage position of FIGS. 2 and 3 and the open operative position of FIG. 1.

The roof engaging member 21 extends outwardly from the inner end 28 to an outer end 32. The outer end 32 includes a flat nailing plate 33 as means for fastening the member 21 to the building roof structure. The nailing plate 33 is appropriately apertured to receive conventional nails.

The plate 33 may be specially drilled with apertures spaced to correspond to the nominal thickness of roof rafters. The scaffolding can thus be secured to standard roof rafters 13 or rafter members of conventional truss design. In addition, plate 33 can be attached to roof sheathing, such as plywood or other appropriate sheathing materials. The plate is also relatively thin and can therefore be inserted between successive shingles or shakes of more completed construction.

The nailing plate 33 is secured by welding or other appropriate fastening methods to the underside of the roof engaging member 21. A cleat 34 is also situated on the underside, intermediate the nailing plate 33 and the inner end of member 21. The cleat 34 rests against the roof surface to slightly elevate the member 21 above the roof surface. This allows access to the fascia area. The cleat 34 is also positioned along the length of the member 21 to allow free folding movement of the member 21 to the closed, storage position. This relationship is illustrated in substantial detail by FIG. 3.

Figure 4:
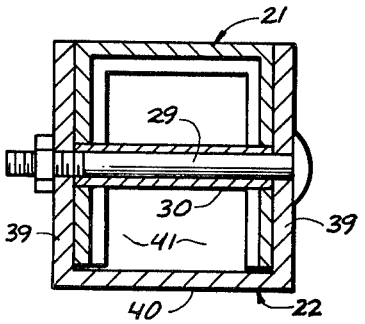
FIG. 4 is a sectional view taken along line 4—4 in FIG. 3.

The upright elongated channel 22 is the primary upright support member for the frame structure and doubles as the "carrying case" for the folded roof engaging member 21, bottom brace member 23, and the turnbuckle means 24. The channel 22 extends from a top end 36 to a bottom end 37. The top end 36 mounts the roof engaging member 21 and the bottom end 37 mounts the bottom brace member 23. The upright channel 22 is formed along a uniform, U-shaped cross section between ends 36 and 37 as shown in FIG. 4. The "U" shape is made up of two opposed side legs 39 interconnected by a base or back 40 that join the legs together. The legs and back 39 and 40 define an elongated recess 41 (FIG. 4) that extends the full length of the channel.

The upright channel 22 is apertured at both ends to pivotably receive and mount the members 21 and 23. The channel also includes an elongated upright slot 42 (FIG. 3) to accommodate elements of the turnbuckle means 24. A handle 43 is mounted on the base or back 40 of the channel. The handle 43 is functional as a handgrip for carrying of the frame member, and for supporting nominal size boards (not shown) for use as a protective railing. Ends of the boards are fitted through the handles 43 when several successive frame members have been secured along a building structure. The boards will be supported at opposite ends, or intermediate their ends by the handles 43 which will usually be aligned horizontally.

Figure 2:
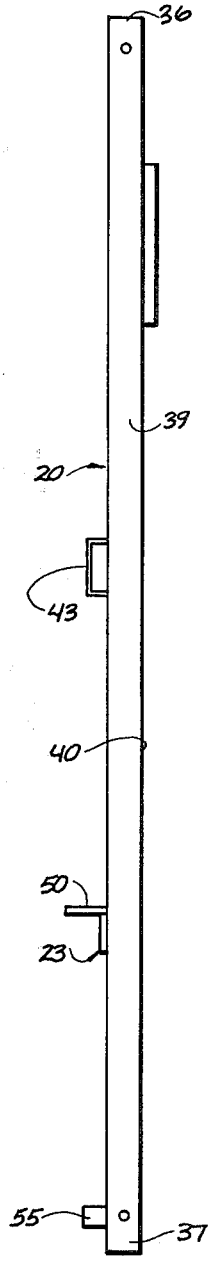
FIG. 2 is an elevational view of the present scaffolding frame member in a folded, storage condition.
Figure 5:
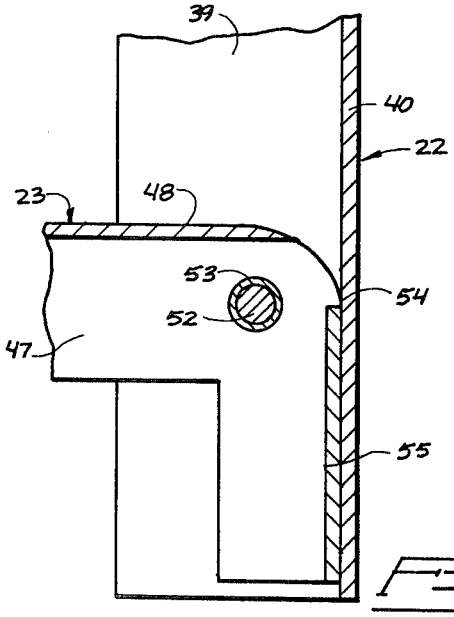
FIG. 5 is an enlarged sectional view of a bottom support brace.
Figure 6:
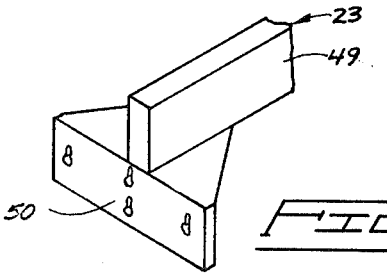
FIG. 6 is a fragmentary pictorial view of a nailing plate for a bottom brace member of the present structure.

The bottom brace member is shown in detail by FIGS. 1 and 5. A portion of the bottom brace member 23 is also illustrated in FIGS. 2 and 5. Member 23 is also comprised of a channel or other conventional structural bar such as "T", "I" or closed geometric channel configurations. The brace member 23 shown in the drawings is "U" shaped, having sides 47 slidably received between the sides 39 of the upright elongated channel 22. The sides 47 are joined by a base 48.

It is preferred that the base 48 face upwardly when the member 23 is pivoted to the operative position. A flat surface is then presented for support of scaffolding planks or other form of platform (not shown).

An outer end 49 (FIG. 1) of the member 23 includes a perpendicular nailing plate 50 that secures the scaffolding frame member to the building wall. The nailing plate 50 like plate 33 is appropriately apertured to receive and position nails for securing the brace to the building structure.

The member 23 extends also to an inner end 51 that is shown in more detail by FIG. 5. The inner end 51 is mounted by a pin 52 within channel 22. This pin 52 may be journalled within an appropriate sleeve 53. FIG. 4 shows the sleeve 53 mounted directly to the member 23 and slidably receiving the pin 52. Stresses along the bottom brace member 23 are therefore spread substantially along the length of the pin rather than being concentrated in a shearing force at the interface between sides 47 and 39. The inner end 51 of bottom brace member 23 is rounded at 54 to allow pivotal motion of the member between the open and closed positions.

A stop 55 may be provided on member 23 to prevent pivotal movement of the member 23 beyond a perpendicular relationship with the upright channel 22. The stop is shown in detail by FIG. 5. Stop 55 may be comprised of a block with a cross-sectional size similar to that of the bottom brace member 23. The stop may be welded or otherwise affixed to the brace member 23. The stop 55 will safely prevent pivotal movement of the brace member 23 past the perpendicular position. Therefore, even if the nailing plate 50 were to come loose on the building structure, the stop 55 and turnbuckle means 24 can function to hold the bottom brace 23 horizontal and support a load thereon.

An important feature of the present invention is provision of the turnbuckle means 24. Means 24 is positioned interconnecting the roof engaging member 21 and upright elongated channel 22. Means 24 can be selectively operated to apply tension between the two members, securely drawing the bottom brace member 23 inwardly against the building structure. The turnbuckle means 24 includes a rather conventional form of turnbuckle, having an end 56 (FIG. 3) mounted to the roof member and an opposite end 57 mounted to the channel 22. A pin 58 pivotally receives and mounts the end 56 to the roof member. Appropriate spacer sleeves (not shown) can be provided on opposite sides of the end 56 on pin 58 in order to center the end 56 between opposed sides of the roof engaging member.

The turnbuckle end 56 leads to a threaded shank 60. Shank 60 is threadably engaged by a block 61 which, in turn, is in threaded engagement with a threaded shank 62. The shanks 60 and 62 are coaxial and directionally threaded so they will be moved together or apart in response to rotational movement of the block 61 about the shank axes.

The turnbuckle end 57 is pivotally mounted to a link 63 on the channel 22. The link 63 includes base pin 64 slidably engaging an outwardly facing surface of channel base 40. The link 63 extends freely through the slot 42 to pivotably mount the turnbuckle end 57. The base pin 64 will slide freely on the channel base 40 along the length of the slot. Disengagement of the base and link from the slot is prevented by an elongated guard 65.

Figure 3:
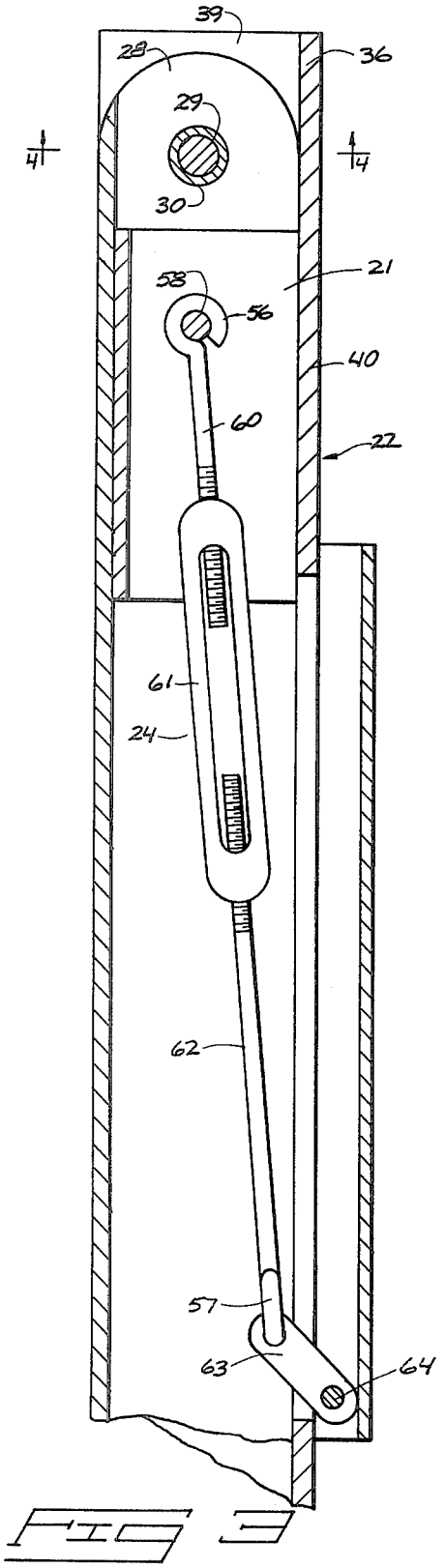
FIG. 3 is an enlarged sectioned view of an upper end of the present frame member when in a folded, storage condition.

The link 63 slides within the slot 42 in response to pivotal movement of the roof engaging member from the closed FIG. 3 position to the open inoperative FIG. 1 position. The link 63 will stop sliding when the roof engaging member 23 is secured to the roof and the bottom brace member 23 engages the building wall 14 or when the link reaches the upper end of the slot 42. A closed, rigid geometrical figure is thereby produced with the angular relationships of the sides not being easily changed. The turnbuckle, at this point, is used to apply force between the roof engaging member and channel 22 to compress or press the bottom brace member 23 firmly against the building side.

From the above technical description, operation of the present invention may now be easily understood. The present scaffolding frame members are preferably mounted to a building structure from the roof. The installer will unfold the member 21 from its FIG. 2 folded position and slide the bottom brace member 23 and channel member 22 over the edge of the fascia. The channel 22 will swing freely to a vertical position and the bottom brace member 23 will open to the FIG. 1 position against the stop 55. The installer can then position the roof engaging member 21 as desired along the roof structure. Preferably, the installer will situate the nailing plate 33 directly over a rafter 13 and secure the nailing plate with several nails to the rafter. Alternatively, the nailing plate can be similarly secured to the roof sheathing. The cleat 34 will rest against the roof structure downwardly of the nailing plate 33 and hold the member 21 at an elevation slightly above the fascia.

Once the roof engaging member 21 has been mounted, the installer can then tighten the turnbuckle block 61 on the turnbuckle shanks 60 and 62. This effectively shortens the length of the turnbuckle member. The roof engaging member 21 and channel member 22 are thus drawn together about the pivot axis at pin 29. Note that the roof engaging member is secured to the roof and will not move. Therefore, the upright channel 22 can only pivot or press inwardly against the bottom brace member 23. Selective tightening of the turnbuckle, then, causes a compressive loading of the bottom brace member 23 in a horizontal direction against wall 14. This inward force, coupled with the safety feature of the stop 55, prevents accidental downward pivotal movement of the brace member 23 from the wall surface. Furthermore, the turnbuckle itself will not permit outward pivotal movement of the upright channel 22.

The installation is completed as the nailing plate 50 of bottom brace member 23 is secured to the structure wall 14. Again, this is done with common nails.

Several of the scaffolding frame members can be positioned along the length of a structure with the bottom brace members aligned horizontally to receive scaffolding planks or platforms. Also, nominal size boards, (such as 2×4's) can be fitted through the aligned handles 43 to supply a secure handrail.

Dismounting of the present scaffolding frame from the building structure simply involves reversal of the steps recited above, starting with removal of the nails holding the plate 50 to the structure wall 14. The turnbuckle block can then be turned to extend the turnbuckle and remove the compressive force on the bottom brace member 23.

The nails holding the roof engaging member 21 in place can then be removed and the entire frame member is free of the structure. The frame can then be lifted onto the roof or lowered onto the ground as desired.

To fold the device for storage, one simply swings the bottom brace member 23 upwardly until its length is received within the confines of the channel recess. Only the stop 55 and nailing plate 50 extend outwardly of the channel as seen in FIG. 2.

The roof engaging member 21 is then folded downwardly, with its full length received within the channel 22. Downward folding motion causes corresponding sliding of the link 63 within the slot 42. The turnbuckle means will pivot on the pin 58 at end 56 and cause sliding movement of the link 63 at end 57. The turnbuckle is nearly completely enclosed between the channel 22 and member 21 when in the closed position.

The resulting closed configuration of the present scaffolding support frame member is shown in FIG. 2. The cross-sectional configuration of the entire scaffolding frame member is only slightly greater than the cross-sectional configuration of the channel 22. Thus, the device may be easily transported both by hand and by vehicle. The handle 43 is positioned along the length of the channel at the approximate center of gravity to facilitae ease in hand carrying the members. The compact cross-sectional configuration facilities ease in storage within transport vehicles such as are typically used in small construction. For example, enough of the frame members may be carried within a conventional pickup truck to perform all the scaffolding support requirements for several residential structures.

It is understood that the above description and attached drawings are given by way of example to set forth a preferred form of the present invention. The scope of my invention, however, is more precisely defined within the following claims.

What I claim is:

1. A scaffolding frame member, for attachment along an exterior wall of a building structure adjacent the roof thereof, comprising:

an elongated rigid channel member having a "U" shaped cross section with a recess extending along its length;

a rigid roof engaging member mounted to the rigid channel member at one end thereof for pivotal movement about a transverse axis and foldable thereon between an open position projecting outwardly of the channel member and a closed position coextensive with the channel member;

turnbuckle means extending between the roof engaging member and channel member selectively operable to urge the roof engaging member about the transverse axis toward the channel member, and foldable with the roof engaging member;

an elongated bottom brace member mounted to the elongated rigid channel at a remaining end thereof for pivotal movement thereon between an open extended operative position, projecting laterally of the channel and a closed storage position coextensive with the channel member; and fastening means at outward ends of the roof engaging member and bottom brace for securing the frame member to a building structure.

2. The scaffolding frame member as defined by claim 1 further comprising a stop on the bottom brace member for engaging the channel member and thereby preventing outward pivotal movement of the bottom brace member beyond a position perpendicular to the channel member.

3. The scaffolding frame member as defined by claim 1 further comprising a carrying handle on the channel member midway between ends thereof, adapted to receive and support a handrail board.

4. The scaffolding frame member as defined by claim 1 wherein the turnbuckle means includes:

a link member slidably mounted within a longitudinal groove in the channel member; and wherein one end of the turnbuckle is mounted to the link member and the remaining end is pivotably mounted to the roof engaging member.

5. The scaffolding frame member as defined by claim 4 further comprising a carrying handle on the channel member midway between ends thereof, adapted to receive and support a handrail plank.

6. The scaffolding frame member as defined by claim 1 wherein the fastening means is comprised of apertured nailing plates affixed to outer ends of the roof engaging member and bottom brace member.

7. The scaffolding frame member as defined by claim 1 further comprising a cleat on a bottom roof engaging surface of the roof engaging member to slightly elevate the roof engaging member above a roof surface.

8. The scaffolding frame member as defined by claim 1 wherein the roof engaging member and the bottom brace are "U" shaped in cross section with the legs thereof slidably fitting between legs of the "U" shape cross section of the channel member.

* * * * *